US008807554B2

(12) United States Patent
Mine et al.

(10) Patent No.: US 8,807,554 B2
(45) Date of Patent: Aug. 19, 2014

(54) SHEET CONVEYING ROLLER AND IMAGE FORMING APPARATUS

(71) Applicant: Sumitomo Rubber Industries, Ltd., Kobe (JP)

(72) Inventors: Akihiro Mine, Kobe (JP); Hirokazu Nishimori, Kobe (JP); Masahiro Yoshizato, Kobe (JP); Toshiyuki Hirai, Kobe (JP); Toshihiro Tamura, Kobe (JP); Keishi Yamamoto, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 13/934,452

(22) Filed: Jul. 3, 2013

(65) Prior Publication Data

US 2014/0042691 A1 Feb. 13, 2014

(30) Foreign Application Priority Data

Aug. 7, 2012 (JP) ..... 2012-174777

(51) Int. Cl.
*B65H 27/00* (2006.01)
*B65H 3/06* (2006.01)

(52) U.S. Cl.
CPC ..... *B65H 27/00* (2013.01); *B65H 2404/5213* (2013.01); *B65H 2404/50* (2013.01); *B65H 2404/51* (2013.01); *B65H 2404/513* (2013.01)
USPC ..... 271/109; 492/30; 492/33; 492/28; 271/264

(58) Field of Classification Search
CPC ..... B65H 2404/52132; B65H 2404/5213; B65H 2404/52131; B65H 2404/54; B65H 27/00; B65H 2404/50; B65H 2404/51; B65H 2404/513
USPC ..... 271/264, 109, 8.1; 492/28, 30, 31, 33, 492/35, 36
See application file for complete search history.

(56) References Cited

U.S. PATENT DOCUMENTS 6,280,370 B1 * 8/2001 Falkenhagen ..... 492/33
7,379,703 B2 * 5/2008 Ito ..... 399/406

(Continued)

FOREIGN PATENT DOCUMENTS

JP 64-24043 U 2/1989
JP 05132162 A * 5/1993 ..... B65H 3/06

(Continued)

OTHER PUBLICATIONS

Notification of Reasons for Refusal dated Jun. 26, 2014 of Japanese Application No. 2012-174777.

*Primary Examiner* — Patrick Cicchino
(74) *Attorney, Agent, or Firm* — Birch, Stewart, Kolasch & Birch, LLP

(57) ABSTRACT

The inventive sheet conveying roller includes a plurality of linear projections provided on an outer peripheral surface of a roller body of an elastic material and each having a generally right-angled triangular cross section which includes a hypotenuse edge and an adjoining edge provided on a forward side and on a rearward side, respectively, with respect to a roller body rotation direction, the adjoining edge aligning with a line perpendicular to a center axis of the roller body. The linear projections are rounded with the hypotenuse edges and the adjoining edges thereof connected to each other by curves as seen in section, and provided integrally with the roller body to be equidistantly arranged on the outer peripheral surface of the roller body.

10 Claims, 4 Drawing Sheets

(56) References Cited

U.S. PATENT DOCUMENTS

| | | | | |
|---|---|---|---|---|
| 7,703,761 | B2 * | 4/2010 | Shiraki | 271/109 |
| 7,753,359 | B2 * | 7/2010 | Suzuki | 271/109 |
| 2002/0115545 | A1 * | 8/2002 | Yoshida et al. | 492/30 |
| 2008/0136085 | A1 * | 6/2008 | Suzuki | 271/109 |
| 2011/0039671 | A1 * | 2/2011 | Chou | 492/28 |
| 2011/0306481 | A1 | 12/2011 | Mine et al. | |

FOREIGN PATENT DOCUMENTS

| | | | |
|---|---|---|---|
| JP | 9-278202 | A | 10/1997 |
| JP | 11-106067 | A | 4/1999 |
| JP | 11-193145 | A | 7/1999 |
| JP | 2003-112833 | A | 4/2003 |
| JP | 2011-256347 | A | 12/2011 |

* cited by examiner

SHEET CONVEYING ROLLER AND IMAGE FORMING APPARATUS

TECHNICAL FIELD

The present invention relates to a sheet conveying roller to be used for conveying sheets in an image forming apparatus such as an electrostatic copying machine or a printer, and to an image forming apparatus including the sheet conveying roller.

BACKGROUND ART

Various types of sheet conveying rollers are incorporated in a sheet conveying mechanism provided, for example, in an image forming apparatus such as an electrostatic copying machine, a laser printer, a plain paper facsimile machine, a copier-printer-facsimile multifunction machine or an inkjet printer, or machinery such as an automatic teller machine (ATM).

Examples of the sheet conveying rollers include a sheet feed roller, a transport roller, a platen roller and a sheet output roller, which are each adapted to be rotated in frictional contact with a sheet (the term "sheet" is herein defined to include a paper sheet, a plastic film and the like, and this definition is effective in the following description) to convey the sheet.

Such a conventional sheet conveying roller typically includes a tubular roller body made of an elastic material such as a crosslinking product of a rubber and having an outer peripheral surface serving as a contact surface to be brought into contact with a sheet.

However, paper dust and dirt generated from paper sheets are liable to adhere to the outer peripheral surface of the roller body. As the roller body is repeatedly brought into contact with paper sheets, the paper dust and the dirt are accumulated on the outer peripheral surface. This reduces the contact area and the friction coefficient of the outer peripheral surface with respect to a paper sheet, thereby causing a sheet transportation failure at a relatively early stage.

A known effective method for maintaining the friction coefficient at a proper level for a longer period of time from the initial stage of use to prevent the sheet transportation failure is to form a plurality of linear projections or grooves parallel to each other axially of the roller body on or in the outer peripheral surface of the roller body. For optimization of such an effect, various configurations for the linear projections and the grooves are contemplated, and used in practical applications.

Particularly, a sheet conveying roller (generally referred to as "K-type knurled roller") is generally widely used, which includes a plurality of linear projections arranged circumferentially equidistantly on an outer peripheral surface of a roller body thereof and each having a cross section such as defined by a normal distribution curve as taken perpendicularly to the axis of the roller body.

Further, a sheet conveying roller (generally referred to as "angularly knurled roller") is also generally widely used, which includes a plurality of grooves formed circumferentially equidistantly in an outer peripheral surface of a roller body thereof as each having a generally V-shaped or U-shaped cross section taken perpendicularly to the axis of the roller body as shown in FIGS. 2 to 4 in Patent Literature 1.

The former K-type knurled roller effectively suppresses the reduction in friction coefficient which may otherwise occur due to adhesion of paper dust and dirt particularly when the roller is repeatedly used. Further, the latter angularly knurled roller effectively improves the friction coefficient at the initial stage of use.

Further, Patent Literature 2 discloses a serrated sheet conveying roller including a roller body having a plurality of linear projections which each have a generally triangular cross section taken perpendicularly to the axis of the roller body and having first and second edges circumferentially inclined at different inclination angles and are circumferentially equidistantly arranged in a state such that a first inclined edge of one of each two adjacent linear projections is directly connected to a second inclined edge of the other linear projection as seen in section.

CITATION LIST

Patent Literature

[Patent Literature 1] JP-HEI11 (1999)-106067A
[Patent Literature 2] JP-2003-112833A

SUMMARY OF THE INVENTION

Problem to be Solved by the Invention

As a result of studies, the inventor found that the prior-art sheet conveying rollers are insufficient in the effect of maintaining the friction coefficient at a proper level for a longer period of time from the initial stage of use.

Particularly, less expensive paper sheets having a higher ash content are widely used for reduction of running costs of the machinery in recent years. The higher ash content paper sheets are more liable to generate paper dust and dirt, so that the aforementioned tendency is remarkable. Further, the rubber has a higher hardness and a lower friction coefficient at a lower temperature, so that the aforementioned tendency is remarkable in a lower temperature and lower humidity environment, e.g., at a temperature of 10° C. at a relative humidity of 15%.

It is an object of the present invention to provide a sheet conveying roller which maintains its friction coefficient at a proper level for a longer period of time from the initial stage of use to reliably prevent the sheet transportation failure particularly when the higher ash content paper sheets are used or when the roller is used in the lower temperature and lower humidity environment, and to provide an image forming apparatus employing the sheet conveying roller.

Solution to Problem

The present invention provides a sheet conveying roller which includes a tubular roller body unitarily formed of an elastic material and having a plurality of linear projections equidistantly arranged on an outer peripheral surface thereof, wherein the linear projections each have a generally right-angled triangular cross section taken perpendicularly to a center axis of the roller body, the generally right-angled triangular cross section including a hypotenuse edge and an adjoining edge located on a forward side and on a rearward side, respectively, with respect to a circumferential roller body rotation direction, the adjoining edge aligning with a line perpendicular to the center axis of the roller body, wherein a corner defined between the hypotenuse edge and the adjoining edge of each of the linear projections and a corner defined between the hypotenuse edge of one of each two adjacent linear projections and the adjoining edge of the other linear projection are rounded as seen in section.

As apparent from the results for inventive examples and comparative examples to be described later, the inventive sheet conveying roller having the plurality of linear projections equidistantly provided on the outer peripheral surface of the roller body as each having the aforementioned sectional shape is capable of maintaining its friction coefficient at a proper level for a longer period of time from the initial stage of use to reliably prevent the sheet transportation failure particularly when the higher ash content paper sheets are used or when the roller is used in the lower temperature and lower humidity environment, as compared with the prior-art sheet conveying rollers described above.

That is, the rotation direction of the inventive sheet conveying roller is defined so that the hypotenuse edge and the adjoining edge (one of two edges adjacent to the right angle) of each of the linear projections are located on the forward side and on the rearward side, respectively, with respect to the rotation direction as seen in section. When the inventive sheet conveying roller is rotated in the rotation direction in press contact with a surface of a sheet being transported, distal portions of the linear projections each have a greater deformation and hence have a greater stress as compared with sheet conveying rollers having other projection/recess configurations.

More specifically, the deformation of the distal portion is increased to increase the stress occurring in the distal portion by the following synergetic effects:

(1) The stress attributable to the press contact is more easily caused to intensively act in a direction such that the distal portion of each of the linear projections is compressed toward an adjoining side, as compared with the K-type knurled roller and the angularly knurled roller of the prior art in which the forward side and the rearward side of each of the linear projections or grooves with respect to the rotation direction have the same inclination angle; and (2) The corner defined between the hypotenuse edge of one of each two adjacent linear projections and the adjoining edge of the other linear projection is rounded as seen in section, so that the compressive deformation described in the above item (1) is not hindered by the adjacent linear projection as compared with the serrated sheet conveying roller of the prior art.

Since the distal portion of each of the linear projections is defined in section by the rounded corner between the hypotenuse edge and the adjoining edge of the linear projection, the distal portion has a smooth continuous outer surface. Therefore, the distal portion has an increased contact area with respect to the surface of the sheet, and the contact area is not significantly changed due to the deformation. This improves and stabilizes a press contact force to be applied to the surface of the sheet.

The linear projections are properly deformed by the aforementioned mechanism even in the aforementioned lower temperature and lower humidity environment to maintain the apparent hardness of the outer peripheral surface of the roller body within the lowest possible range. Even if the crosslinking product of the rubber composition of the roller body is hardened in the lower temperature and lower humidity environment, it is possible to provide a sufficient contact area with respect to the surface of the sheet to suppress the reduction in friction coefficient.

In addition, when the linear projections are brought out of contact with the surface of the sheet by the rotation of the inventive sheet conveying roller in the aforementioned rotation direction, paper dust and dirt intruding into recesses defined between the linear projections and widely open rearward with respect to the rotation direction are smoothly removed from the recesses along hypotenuse faces of the linear projections each defined in section by the hypotenuse edge.

Since the recesses between the linear projections are each defined in section by the rounded corner between the hypotenuse edge of one of each two adjacent linear projections and the adjoining edge of the other linear projection, the recesses each have a smooth continuous inner surface. Thus, the paper dust and the dirt intruding into the recesses are prevented from being trapped between the adjacent linear projections, and the removal of the paper dust and the dirt is not hindered.

According to the present invention, the friction coefficient can be maintained at a proper level for a longer period of time from the initial stage of use to reliably prevent the sheet transportation failure particularly when the higher ash content paper sheets are used or when the roller is used in the lower temperature environment.

In the inventive sheet conveying roller, an open angle defined between each two adjacent linear projections about the center axis is preferably not less than 2 degrees and not greater than 8 degrees, and the linear projections preferably each have a height of not less than 0.1 mm and not greater than 0.5 mm as measured radially of the roller.

Where the open angle defined between the linear projections and the height of the linear projection respectively fall within the aforementioned ranges, it is possible to improve the effect of increasing the deformation of the distal portions of the linear projections and the effect of removing the paper dust and the dirt from the recesses by the aforementioned mechanism, while properly maintaining the friction coefficient with respect to the sheet at the initial stage of use. This makes it possible to maintain the friction coefficient at a proper level for a longer period of time from the initial stage of use to further improve the sheet transportation failure preventing effect particularly when the higher ash content paper sheets are used.

The roller body is preferably unitarily formed of a crosslinking product of a rubber composition containing an ethylene propylene rubber as a rubber component and a peroxide as a crosslinking agent.

The crosslinking product of the rubber composition is excellent in lower-temperature characteristic properties and, for example, has a sufficient flexibility, a sufficient press contact force with respect to the sheet and a proper friction coefficient even in the lower temperature and lower humidity environment. This makes it possible to maintain the friction coefficient at a proper level for a longer period of time from the initial stage of use to further improve the sheet transportation failure preventing effect particularly when the roller is used in the lower temperature and lower humidity environment.

The rubber component of the rubber composition preferably includes the ethylene propylene rubber and an isoprene rubber (IR), and the mass ratio of the IR to the ethylene propylene rubber is preferably not less than 10/90 and not greater than 50/50.

The IR has lower affinity for an organic component such as a sizing agent (which is contained in the paper dust and causes the paper dust to adhere to the outer peripheral surface of the roller body) than the ethylene propylene rubber. Therefore, the adhesion of the paper dust to the outer peripheral surface can be more effectively suppressed by blending the IR in the aforementioned proportion as the rubber component. Further, the IR has a lower glass transition temperature, so that the lower-temperature characteristic properties of the crosslinking product can be further improved by blending the IR in the aforementioned proportion as the rubber component.

This makes it possible to maintain the friction coefficient at a proper level for a longer period of time from the initial stage of use to further improve the sheet transportation failure preventing effect particularly when the higher ash content paper sheets are used or when the roller is used in the lower temperature and lower humidity environment.

The present invention also provides an image forming apparatus which includes the inventive sheet conveying roller.

According to the present invention, thanks to the function of the sheet conveying roller, the image forming apparatus is substantially free from problems of the sheet transportation failure and sheet jamming associated with the sheet transportation failure, which may otherwise occur particularly when the higher ash content paper sheets are used or when the image forming apparatus is used in the lower temperature and lower humidity environment.

Effects of the Invention

According to the present invention, the sheet conveying roller is provided which can maintain its friction coefficient at a proper level for a longer period of time from the initial stage of use to reliably prevent the sheet transportation failure particularly when the higher ash content paper sheets are used or when the roller is used in the lower temperature and lower humidity environment, and the image forming apparatus is provided which employs the sheet conveying roller.

EMBODIMENTS OF THE INVENTION

Figure 1A:
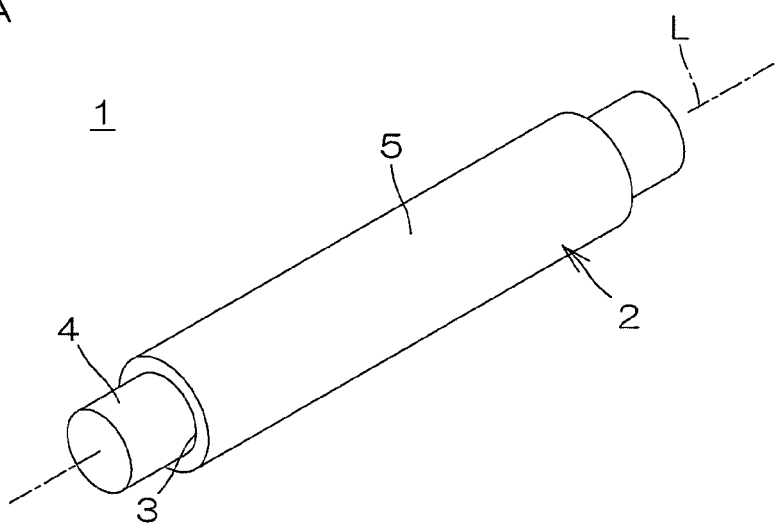
FIG. 1A is a perspective view showing a sheet conveying roller according to one embodiment of the present invention.
Figure 1B:
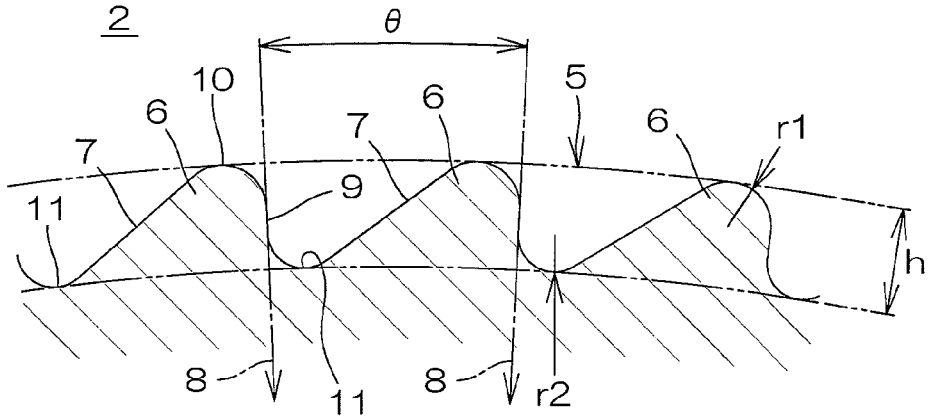
FIG. 1B is a sectional view of an outer peripheral surface portion of a roller body of the inventive sheet conveying roller taken perpendicularly to the axis of the roller body.
Figure 2:
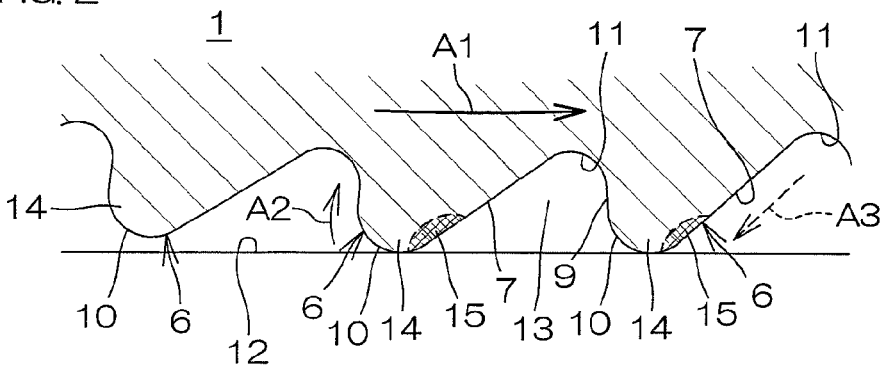
FIG. 2 is a sectional view for explaining a state observed when a sheet is conveyed with the use of the sheet conveying roller according to the embodiment shown in FIGS. 1A and 1B.

FIG. 1A is a perspective view showing a sheet conveying roller according to one embodiment of the present invention. FIG. 1B is a sectional view of an outer peripheral surface portion of a roller body of the inventive sheet conveying roller taken perpendicularly to the axis of the roller body. FIG. 2 is a sectional view for explaining a state observed when a sheet is conveyed with the use of the sheet conveying roller according to the embodiment.

Referring to FIG. 1A, the sheet conveying roller 1 according to this embodiment includes a hollow cylindrical roller body 2 unitarily formed of an elastic material, and a shaft 4 inserted through a center through-hole 3 of the roller body 2. The shaft 4 is made of, for example, a metal, a ceramic material, a hard resin or the like.

Referring to FIGS. 1A and 1B, the roller body 2 includes a plurality of linear projections 6 circumferentially equidistantly provided parallel to a center axis L thereof on an outer peripheral surface 5 thereof.

The linear projections 6 each have a generally right-angled triangular cross section taken perpendicularly to the center axis L of the roller body 2 as shown in FIG. 1B. The generally right-angled triangular cross section includes a hypotenuse edge 7 located on one of opposite sides defined circumferentially of the roller body 2 (on a left side in FIG. 1B), and an adjoining edge 9 located on the other side (on a right side in FIG. 1B) and aligning with a line 8 perpendicular to the center axis L.

One of circumferentially opposite end portions of the hypotenuse edge 7 (a right end portion of the hypotenuse edge 7 in FIG. 1B) and the adjoining edge 9 (i.e., the hypotenuse edge 7 and the adjoining edge 9 of each of the linear projections 6) are connected together by a curve 10 to define a rounded corner therebetween. Similarly, the other circumferential end portion of the hypotenuse edge 7 (a left end portion of the hypotenuse edge 7 in FIG. 1B) and the adjoining edge 9 of an adjacent linear projection 6 (i.e., the hypotenuse edge 7 of one of each two adjacent linear projections 6 and the adjoining edge of the other linear projection 6) are connected together by a curve 11 to define a rounded corner therebetween.

Since the linear projections 6 each have such a cross section, the mechanism previously described makes it possible to maintain the friction coefficient at a proper level for a longer period of time from the initial stage of use to reliably prevent the sheet transportation failure particularly when higher ash content paper sheets are used or when the roller is used in a lower temperature and lower humidity environment, as compared with the prior-art sheet conveying rollers.

Referring to FIGS. 1A, 1B and 2, the rotation direction of the sheet conveying roller 1 is defined so that the hypotenuse edge 7 and the adjoining edge 9 of each of the linear projections 6 are located on the forward side and on the rearward side, respectively, with respect to the rotation direction as seen in section and indicated by a bold solid line arrow A1. When the sheet conveying roller 1 is rotated in the rotation direction in press contact with a surface 12 of a paper sheet being transported, distal portions 14 of the linear projections 6 each have a greater deformation and hence have a greater stress as compared with sheet conveying rollers having other projection/recess configurations.

More specifically, the following synergetic effects are provided:

(1) The stress attributable to the press contact is more easily caused to intensively act in a direction such that the distal portion 14 of each of the linear projections 6 is compressed toward an adjoining side (in a direction indicated by a thin line arrow A2 in FIG. 2), as compared with the K-type knurled roller and the angularly knurled roller of the prior art in which the forward side and the rearward side of each of the linear projections or grooves with respect to the rotation direction have the same inclination angle; and (2) The hypotenuse edge 7 of one of each two adjacent linear projections 6 and the adjoining edge 9 of the other linear projection 6 are connected to each other by the curve 11 as seen in section to define a rounded corner, so that the deformation described in the above item (1) is not hindered by the adjacent linear projection 6 as compared with the serrated sheet conveying roller of the prior art. Thus, the deformation of the distal portion 14 of the linear projection 6 in the thin line arrow direction A2 is increased to increase a stress occurring particularly in a region 15 of the distal portion 14.

Since the distal portion 14 of each of the linear projections 6 is defined in section by the rounded corner between the hypotenuse edge 7 and the adjoining edge 9 of the linear projection 6 connected by the curve 10, the distal portion 14 has a smooth continuous outer surface. Therefore, the distal portion 14 has an increased contact area with respect to the surface 12 of the sheet, and the contact area is not significantly changed due to the deformation. This improves and stabilizes a press contact force to be applied to the surface 12 of the sheet.

The linear projections 6 are properly deformed by the aforementioned mechanism even in the lower temperature and lower humidity environment previously described, thereby maintaining the apparent hardness of the outer peripheral surface 5 of the roller body 2 within the lowest possible range. Even if the crosslinking product of the rubber composition of the roller body 2 is hardened in the lower temperature and lower humidity environment, it is possible to provide a sufficient contact area with respect to the surface 12 of the sheet to suppress the reduction in friction coefficient.

In addition, when the linear projections 6 are brought out of contact with the surface 12 of the sheet by the rotation of the sheet conveying roller 1 in the rotation direction indicated by the arrow A1, paper dust and dirt (not shown) intruding into recesses 13 defined between the linear projections 6 and widely open rearward with respect to the rotation direction are smoothly removed from the recesses 13 along hypotenuse faces of the linear projections each defined in section by the hypotenuse edges 7 as indicated by a broken line arrow A3 in FIG. 2.

Since the hypotenuse edge 7 and the adjoining edge 9 are connected by the curve 11 to define the rounded corner, the recesses 13 defined between the adjacent linear projections 6 each have a smooth continuous inner surface. Thus, the paper dust and the dirt (not shown) intruding into the recesses 13 are prevented from being trapped between the adjacent linear projections 6, and the removal of the paper dust and the dirt is not hindered.

Therefore, the friction coefficient can be maintained at a proper level for a longer period of time from the initial stage of use to reliably prevent the sheet transportation failure particularly when the higher ash content paper sheets are used or when the roller is used in the lower temperature environment.

Referring to FIGS. 1A and 1B, an open angle θ defined between each two adjacent linear projections 6 about the center axis L is preferably not less than 2 degrees and not greater than 8 degrees, and the linear projections 6 preferably each have a height h of not less than 0.1 mm and not greater than 0.5 mm as measured radially of the roller.

If the open angle θ is less than 2 degrees, a distance between the adjacent linear projections 6 is too short. This excessively increases the inclination angle of the hypotenuse edge 7 and makes it impossible to sufficiently increase the radius of the curve 11 connecting the hypotenuse edge 7 and the adjoining edge 9. Therefore, the effect of significantly deforming the linear projections 6 in the rotation of the sheet conveying roller 1 to improve and stabilize the press contact force to be applied to the surface 12 of the sheet and the effect of removing the paper dust and the dirt from the recesses 13 cannot be sufficiently provided by the provision of the hypotenuse edges 7 and the curves 11, so that the sheet transportation failure is liable to occur.

If the open angle θ is greater than 8 degrees, on the other hand, the number of the linear projections 6 to be provided on the outer peripheral surface 5 of the roller body 2 is reduced to reduce the contact area of the outer peripheral surface 5 with respect to the surface 12 of the sheet. Particularly, the friction coefficient at the initial stage of use is liable to be reduced, resulting in the sheet transportation failure.

Where the open angle θ defined between the adjacent linear projections 6 is within the aforementioned range, in contrast, it is possible to properly maintain the friction coefficient with respect to the sheet at the initial stage of use while further improving the effect of increasing the deformation of the distal portions 14 of the linear projections 6 and the effect of removing the paper dust and the dirt from the recesses 13 by the aforementioned mechanism. This makes it possible to maintain the friction coefficient at a proper level for a longer period of time from the initial stage of use to further improve the sheet transportation failure preventing effect particularly when the higher ash content paper sheets are used.

For further improvement of these effects, the open angle θ is further preferably not less than 4 degrees in the aforementioned range.

If the height h of the linear projection 6 is less than 0.1 mm, it is impossible to impart the hypotenuse edge 7 with a sufficient inclination angle. Therefore, the effect of increasing the deformation of the distal portions 14 of the linear projections 6 in the rotation of the sheet conveying roller 1 to improve and stabilize the press contact force to be applied to the surface 12 of the sheet cannot be sufficiently provided by the provision of the hypotenuse edge 7 as previously described, so that the sheet transportation failure is liable to occur.

If the height h of the linear projection is greater than 0.5 mm, on the other hand, the number of the linear projections 6 to be provided on the outer peripheral surface 5 of the roller body 2 is liable to be reduced to reduce the contact area of the outer peripheral surface 5 with respect to the surface 12 of the sheet. Particularly, the friction coefficient at the initial stage of use is liable to be reduced, resulting in the sheet transportation failure.

Where the height h of the linear projection 6 is within the aforementioned range, in contrast, it is possible to properly maintain the friction coefficient with respect to the sheet at the initial stage of use while improving the effect of increasing the deformation of the distal portions 14 of the linear projections 6 by the aforementioned mechanism. This makes it possible to maintain the friction coefficient at a proper level for a longer period of time from the initial stage of use to further improve the sheet transportation failure preventing effect particularly when the higher ash content paper sheets are used.

The radius r1 of the curve 10 connecting the one circumferential end portion (the right end portion in FIG. 1B) of the hypotenuse edge 7 and the adjoining edge 9 of the linear projection 6 (i.e., the hypotenuse edge 7 and the adjoining edge 9 of each of the linear projections 6) as seen in section is preferably not less than 0.08 mm and not greater than 0.15 mm, particularly preferably not less than 0.1 mm and not greater than 0.13 mm, in order to further enhance the effect of the provision of the curve 10 described above.

Further, the radius r2 of the curve 11 connecting the other circumferential end portion (the left end portion in FIG. 1B) of the hypotenuse edge 7 of the linear projection 6 and the adjoining edge 9 of the adjacent linear projection 6 (i.e., the hypotenuse edge 7 of one of each two adjacent linear projections 6 and the adjoining edge 9 of the other linear projection 6) as seen in section is preferably not less than 0.03 mm and not greater than 0.14 mm, particularly preferably not less than 0.08 mm and not greater than 0.12 mm, in order to further enhance the effect of the provision of the curve 11 described above.

The roller body 2 is preferably unitarily formed of a crosslinking product of a rubber composition containing an ethylene propylene rubber as a rubber component and a peroxide as a crosslinking agent.

The crosslinking product of the rubber composition is excellent in lower-temperature characteristic properties and, for example, has a sufficient flexibility to maintain a sufficient press contact force with respect to the sheet, and has a proper friction coefficient even in the lower temperature and lower humidity environment. This makes it possible to maintain the friction coefficient at a proper level for a longer period of time from the initial stage of use to further improve the sheet transportation failure preventing effect particularly when the roller is used in the lower temperature and lower humidity environment.

The rubber component of the rubber composition includes an ethylene propylene rubber and an IR, and the mass ratio of the IR to the ethylene propylene rubber is preferably not less than 10/90 and not greater than 50/50.

The IR has lower affinity for an organic component such as a sizing agent (which is contained in the paper dust and causes the paper dust to adhere to the outer peripheral surface 5 of the roller body 2, i.e., to the linear projections 6 and the recesses 13) than the ethylene propylene rubber. Therefore, the adhesion of the paper dust to the outer peripheral surface 5 can be more effectively suppressed by blending the IR in the aforementioned proportion as the rubber component. Since the IR has a lower glass transition temperature, the lower-temperature characteristic properties of the crosslinking product can be further improved by blending the IR in the aforementioned proportion as the rubber component.

This makes it possible to maintain the friction coefficient at a proper level for a longer period of time from the initial stage of use to further improve the sheet transportation failure preventing effect particularly when the higher ash content paper sheets are used or when the roller is used in the lower temperature and lower humidity environment.

Examples of the ethylene propylene rubber include an ethylene propylene rubber (EPM) which is a copolymer of ethylene and propylene in a narrow sense, and an ethylene propylene diene rubber (EPDM) which is a copolymer of ethylene, propylene and a diene. The EPDM is particularly preferred.

Any of various copolymers prepared by copolymerizing ethylene, propylene and a diene are usable. Examples of the diene include ethylidene norbornene (ENB) and dicyclopentadiene (DCPD).

Either a so-called oil-extension EPDM extended with an extension oil or a so-called non-oil-extension EPDM not extended with an extension oil is usable as the EPDM. In consideration of the handling ease in adding an additive such as a crosslinking agent to the rubber component including the two rubbers and kneading the resulting mixture for preparation of the rubber composition and the working ease in forming the rubber composition into the sheet conveying roller, the EPDM is preferably an oil-extension EPDM.

Exemplary ENB-type oil-extension EPDMs in which the diene is the ENB include ESPRENE (registered trade name) 670F (having a mass ratio of rubber:extension oil=100:100) and ESPRENE 671F (having a mass ratio of rubber:extension oil=100:70) available from Sumitomo Chemical Co., Ltd., and MITSUI EPT3042E (having a mass ratio of rubber:extension oil=100:120) available from Mitsui Chemicals, Inc. These ENB-type oil-extension EPDMs may be used either alone or in combination.

An exemplary DCPD-type oil-extension EPDM in which the diene is the DCPD is ESPRENE 400 (having a mass ratio of rubber:extension oil=100:100) available from Sumitomo Chemical Co., Ltd.

The exemplary EPDMs described above may be used either alone or in combination.

Where any of the oil-extension EPDMs is used as the EPDM, the proportion of the IR described above is based on the amount of the rubber component (EPDM) contained in the oil-extension EPDM.

Any of various IRs such as synthesized by solution polymerization of isoprene with the use of a Ziegler catalyst, a lithium catalyst or the like is usable as the IR.

The IR is not limited to these IRs, but examples thereof include NIPOL (registered trade name) IR2200 (having a specific gravity of 0.91 and a Mooney viscosity (median) of 82) and IR2200L (having a specific gravity of 0.91 and a Mooney viscosity (median) of 70) available from Nippon Zeon Corporation, at least one of which is used.

The peroxide crosslinking agent per se does not cause blooming, and there is no need to use a vulcanization accelerating agent and a vulcanization acceleration assisting agent (stearic acid or the like) which may otherwise reduce the friction coefficient due to blooming on the outer peripheral surface 5 of the roller body 2 when a conventional sulfur crosslinking agent is used. Therefore, the peroxide crosslinking agent is advantageous in that the friction coefficient can be maintained at a proper level for a longer period of time from the initial stage of use to further improve the sheet transportation failure preventing effect.

Examples of the peroxide crosslinking agent include benzoyl peroxide, 1,1-bis(tert-butylperoxy)-3,3,5-trimethylcyclohexane, 2,5-dimethyl-2,5-di(benzoylperoxy)hexane, di(tert-butylperoxy)diisopropylbenzene, 1,4-bis[(tert-butyl)peroxyisopropyl]benzene, di(tert-butylperoxy)benzoate, tert-butylperoxybenzoate, dicumyl peroxide, tert-butyl cumyl peroxide, 2,5-dimethyl-2,5-di(tert-butylperoxy)hexane, di-tert-butyl peroxide and 2,5-dimethyl-2,5-di(tert-butylperoxy)-3-hexene, which may be used either alone or in combination.

The proportion of the peroxide crosslinking agent to be blended is preferably not less than 0.8 parts by mass and not greater than 5 parts by mass, particularly preferably not less than 1.5 parts by mass and not greater than 3.5 parts by mass, based on 100 parts by mass of the rubber component.

If the proportion of the peroxide crosslinking agent is less than the aforementioned range, the abrasion resistance of the sheet conveying roller is liable to be reduced. If the proportion of the peroxide crosslinking agent is greater than the aforementioned range, the sheet conveying roller is liable to have an excessively high hardness, failing to exhibit a desired friction coefficient.

As required, various additives including a reinforcing agent/filler such as carbon black, an oil and a plasticizer may be blended in the rubber composition.

The roller body 2 is produced by preparing the rubber composition containing the components described above and forming the rubber composition into a predetermined shape, for example, by a press molding method, an extrusion method or the like.

In the press molding method, for example, a mold having a cavity complementary in three-dimensional shape to the roller body 2 having the plurality of linear projections 6 of the aforementioned predetermined configuration on the outer peripheral surface 5 is prepared, and the rubber composition is fed into the cavity of the mold. Then, the mold is heated under pressurized conditions to crosslink the rubber composition. Thus, the roller body 2 is produced.

In the extrusion method, a die complementary in cross sectional shape to the roller body 2 having the plurality of linear projections 6 of the aforementioned predetermined configuration on the outer peripheral surface 5 is connected to an extruder, and the rubber composition is extruded into a tubular shape and crosslinked. Thus, the roller body 2 is produced.

The roller body 2 and the shaft 4 are unified together, for example, by press-inserting a shaft 4 having an outer diameter greater than the inner diameter of the through-hole 3 of the roller body 2 into the through-hole 3, by bonding the shaft 4 to the roller body 2 with an adhesive agent, or by bonding the shaft 4 to the roller body 2 with a vulcanizing adhesive agent in the crosslinking of the roller body 2.

As required, opposite end portions of the roller body 2 may be cut so that the axial length of the roller body 2 or the width of the sheet conveying roller 1 has a predetermined value at given time before or after the unification. Thus, the sheet conveying roller 1 shown in FIG. 1 is produced.

The roller body 2 may be formed in a double layer structure including an outer layer adjacent to the outer peripheral surface 5 and an inner layer adjacent to the shaft 4. In this case, at least the outer layer is formed of the rubber composition described above.

The crosslinking product of the rubber composition forming the roller body 2 preferably has a complex elastic modulus E* of not less than 1.0 MPa and not greater than 2.5 MPa.

If the complex elastic modulus E* is less than the aforementioned range, the rigidity of the linear projections 6 is liable to be reduced to reduce a stress occurring when the linear projections 6 are brought into press contact with the surface 12 of the sheet. If the complex elastic modulus E* is greater than the aforementioned range, on the other hand, the flexibility of the linear projections 6 is liable to be reduced to reduce the deformation of the linear projections 6 and the contact area of the linear projections 6 with respect to the surface 12 of the sheet when the linear projections 6 are brought into press contact with the surface 12 of the sheet. In either of the cases, the friction coefficient is reduced, so that the sheet transportation failure is liable to occur.

Where the complex elastic modulus E* of the crosslinking product is within the aforementioned range, in contrast, it is possible to suppress the reduction in the rigidity of the linear projections 6 to maintain the stress in a proper range when the linear projections 6 are brought into press contact with the surface 12 of the sheet, and to improve the deformability and the conformability of the linear projections to increase the deformation of the linear projections 6 when the linear projections 6 are brought into press contact with the surface 12 of the sheet. This makes it possible to maintain the friction coefficient at a proper level for a longer period of time from the initial stage of use to further improve the sheet transportation failure preventing effect.

The crosslinking product preferably has a loss factor tan δ of not less than 0.03 and not greater than 0.20.

It is practically difficult to produce a crosslinking product of the aforementioned rubber composition having a loss factor tan δ of less than the aforementioned range. If the loss factor tan δ is greater than the aforementioned range, phase offset is liable to occur when the linear projections 6 are deformed, thereby reducing the conformability.

Where the loss factor tan δ is within the aforementioned range, in contrast, it is possible to suppress a stick-slip phenomenon occurring between the linear projections 6 and the surface 12 of the sheet and to improve the friction coefficient. This makes it possible to maintain the friction coefficient at a proper level for a longer period of time from the initial stage of use to further improve the sheet transportation failure preventing effect.

In order to control the complex elastic modulus E* and the loss factor tan δ of the crosslinking product within the aforementioned ranges, the types and the proportions of the rubber component, the peroxide crosslinking agent, the reinforcing agent/filler, the oil, the plasticizer and the like of the rubber composition may be properly changed.

In the present invention, the complex elastic modulus E* and the loss factor tan δ are each expressed as a value that is determined through an ordinary method, for example, based on the measurement results obtained in an environment at 23° C. by means of a dynamic viscoelasticity measurement device.

The roller body 2 may be porous with a multiplicity of independent or continuous cells provided therein. For improvement of the deformability and the durability of the linear projections 6 and the durability of the overall roller body 2, however, the roller body 2 is preferably non-porous substantially without cells.

The inventive sheet conveying roller 1 can be used as a sheet conveying roller such as a sheet feed roller, a transport roller, a platen roller or a sheet output roller to be incorporated in a sheet conveying mechanism provided, for example, in an image forming apparatus such as an electrostatic copying machine, a laser printer, a plain paper facsimile machine, a copier-printer-facsimile multifunction machine or an inkjet printer, or machinery such as an automatic teller machine (ATM).

An image forming apparatus according to the present invention includes the inventive sheet conveying roller. According to the present invention, thanks to the function of the inventive sheet conveying roller, the image forming apparatus is substantially free from the problems of the sheet transportation failure and sheet jamming associated with the sheet transportation failure, which may otherwise occur particularly when the higher ash content paper sheets are used or when the image forming apparatus is used in the lower temperature and lower humidity environment.

EXAMPLES

Example 1

Preparation of Rubber Composition

An ENB-type oil-extension EPDM (ESPRENE (registered trade name) 670F (having a mass ratio of rubber:extension oil=100:100) available from Sumitomo Chemical Co., Ltd. as described above) was used as a base rubber.

Then, 3 parts by mass of dicumyl peroxide (PERCUMYL (registered trade name) D available from NOF Corporation) as a peroxide crosslinking agent and 5 parts by mass of carbon black (HAF available under the trade name of SEAST 3 from Tokai Carbon Co., Ltd.) as a reinforcing agent/filler were blended with 200 parts by mass of the oil-extension EPDM, and the resulting mixture was kneaded. Thus, a rubber composition was prepared.

In turn, the rubber composition was fed into a cavity of a mold complementary in three-dimensional shape to a roller body 2 having a plurality of linear projections 6 of the following predetermined configuration on an outer peripheral surface 5, and crosslinked at 160° C. under pressurized conditions for 25 minutes, whereby the roller body 2 was produced as having a maximum diameter of 15.25 mm, an inner diameter of 11.0 mm and a length of 20 mm. Then, a resin shaft having a diameter of 12 mm was press-inserted into a through-hole 3 of the roller body 2. Thus, a sheet conveying roller 1 was produced.

Figure 3:
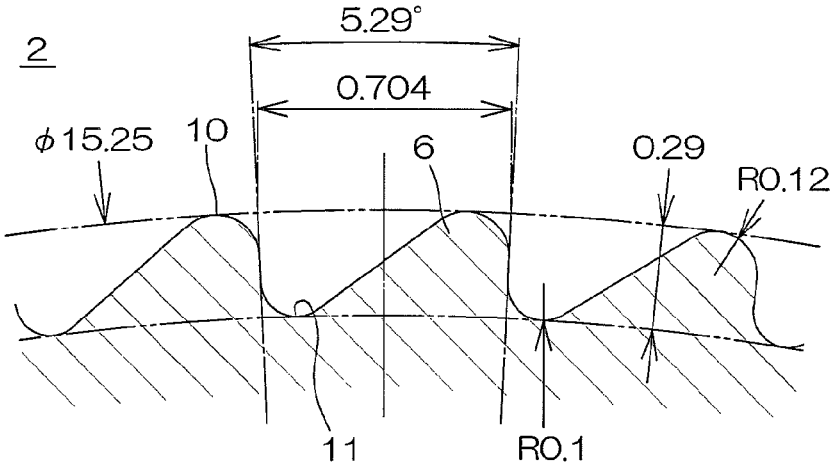
FIG. 3 is a sectional view for explaining the shape and the dimensions of linear projections of a sheet conveying roller of Example 1 out of inventive examples and comparative examples.

The linear projections 6 each had a generally right-angled triangular cross-sectional shape satisfying the requirements specified by the present invention as shown in FIG. 3. The dimensions and the number of the linear projections 6 are shown in FIG. 3 and described below:

(a) An open angle θ defined between adjacent linear projections 6: 5.29 degrees
(b) A distance between the adjacent linear projections 6: 0.704 mm;
(c) The height h of the linear projection 6: 0.29 mm;
(d) The radius r1 of a curve 10: 0.12 mm
(e) The radius r2 of a curve 11: 0.1 mm
(f) The number of the linear projections 6: 68

Example 2

A roller 1 having the same shape and the same dimensions as in Example 1 was produced in substantially the same manner as in Example 1, except that a rubber composition prepared by blending 140 parts by mass of the oil-extension EPDM, 30 parts by mass of an IR(NIPOL (registered trade name) IR2200 (having a specific gravity of 0.91 and a Mooney viscosity (median) of 82) available from Nippon Zeon Corporation as described above), 3 parts by mass of dicumyl peroxide (PERCUMYL (registered trade name) D available from NOF Corporation) as a peroxide crosslinking agent and 5 parts by mass of carbon black (HAF available under the trade name of SEAST 3 from Tokai Carbon Co., Ltd.) as a reinforcing agent/filler and kneading the resulting mixture was used.

Example 3

Figure 4:
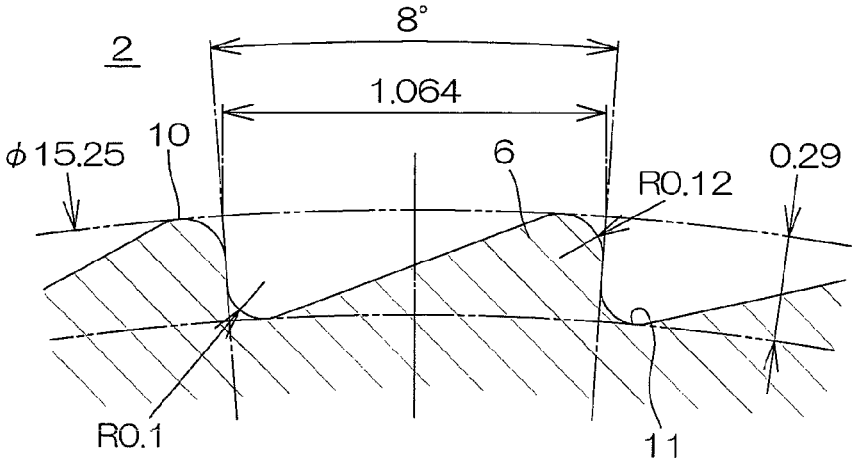
FIG. 4 is a sectional view for explaining the shape and the dimensions of linear projections of a sheet conveying roller of Example 2.

A sheet conveying roller 1 was produced in substantially the same manner as in Example 1, except that a different mold was used to impart each of the linear projections 6 with a generally right-angled triangular cross-sectional shape satisfying the requirements specified by the present invention as shown in FIG. 4, and the dimensions and the number of the linear projections 6 were changed as shown in FIG. 4 and described below:

(a) An open angle θ defined between adjacent linear projections 6: 8 degrees
(b) A distance between the adjacent linear projections 6: 1.064 mm;
(c) The height h of the linear projection 6: 0.29 mm;
(d) The radius r1 of a curve 10: 0.12 mm
(e) The radius r2 of a curve 11: 0.1 mm
(f) The number of the linear projections 6: 45

The roller body 2 had the same maximum diameter, the same inner diameter and the same length as in Example 1.

Example 4

Figure 5:
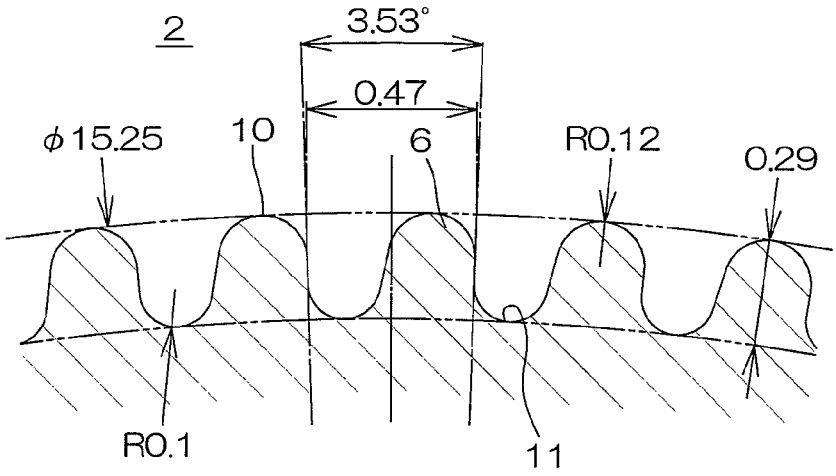
FIG. 5 is a sectional view for explaining the shape and the dimensions of linear projections of a sheet conveying roller of Example 3.

A sheet conveying roller 1 was produced in substantially the same manner as in Example 1, except that a different mold was used to impart each of the linear projections 6 with a generally right-angled triangular cross-sectional shape satisfying the requirements specified by the present invention as shown in FIG. 5, and the dimensions and the number of the linear projections 6 were changed as shown in FIG. 5 and described below:

(a) An open angle θ defined between adjacent linear projections 6: 3.53 degrees
(b) A distance between the adjacent linear projections 6: 0.47 mm;
(c) The height h of the linear projection 6: 0.29 mm;
(d) The radius r1 of a curve 10: 0.12 mm
(e) The radius r2 of a curve 11: 0.1 mm
(f) The number of the linear projections 6: 102

The roller body 2 had the same maximum diameter, the same inner diameter and the same length as in Example 1.

Example 5

Figure 6:
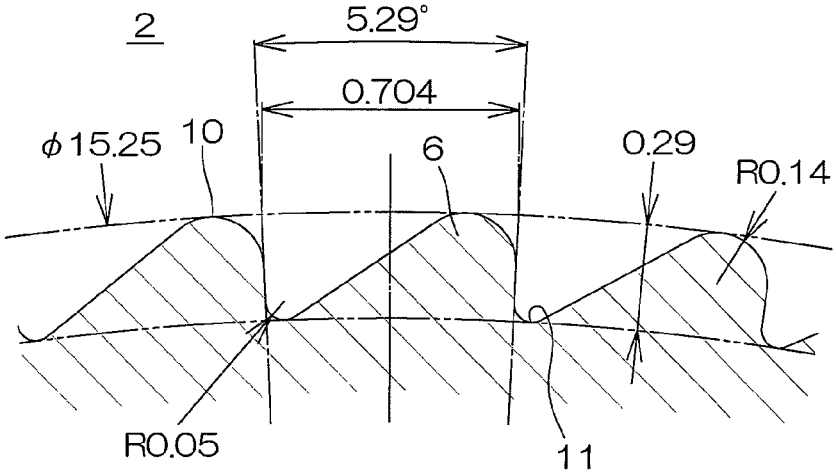
FIG. 6 is a sectional view for explaining the shape and the dimensions of linear projections of a sheet conveying roller of Example 4.

A sheet conveying roller 1 was produced in substantially the same manner as in Example 1, except that a different mold was used to impart each of the linear projections 6 with a generally right-angled triangular cross-sectional shape satisfying the requirements specified by the present invention as shown in FIG. 6, and the dimensions and the number of the linear projections 6 were changed as shown in FIG. 6 and described below:

(a) An open angle θ defined between adjacent linear projections 6: 5.29 degrees
(b) A distance between the adjacent linear projections 6: 0.704 mm;
(c) The height h of the linear projection 6: 0.29 mm;
(d) The radius r1 of a curve 10: 0.14 mm
(e) The radius r2 of a curve 11: 0.05 mm
(f) The number of the linear projections 6: 68

The roller body 2 had the same maximum diameter, the same inner diameter and the same length as in Example 1.

Comparative Example 1

Figure 7:
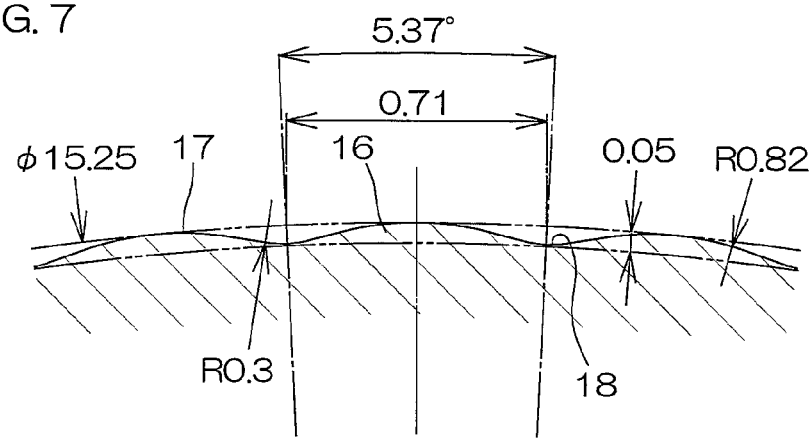
FIG. 7 is a sectional view for explaining the shape and the dimensions of linear projections of a sheet conveying roller of Comparative Example 1.

A K-type knurled sheet conveying roller of the prior art was produced in substantially the same manner as in Example 1, except that a different mold was used to produce a roller body 2 including linear projections 16 each having a cross-sectional shape such as defined by a normal distribution curve. The dimensions and the number of the linear projections 16 are shown in FIG. 7 and described below:

(g) An open angle θ defined between adjacent linear projections 16: 5.37 degrees
(h) A distance between the adjacent linear projections 16: 0.71 mm;
(i) The height h of the linear projection 16: 0.05 mm;
(j) The radius r1 of a distal portion 17 of the linear projection 16: 0.82 mm
(k) The radius r2 of a recess 18 between the adjacent linear projections 16: 0.3 mm
(l) The number of the linear projections 16: 67

The roller body 2 had the same maximum diameter, the same inner diameter and the same length as in Example 1.

Comparative Example 2

Figure 8:
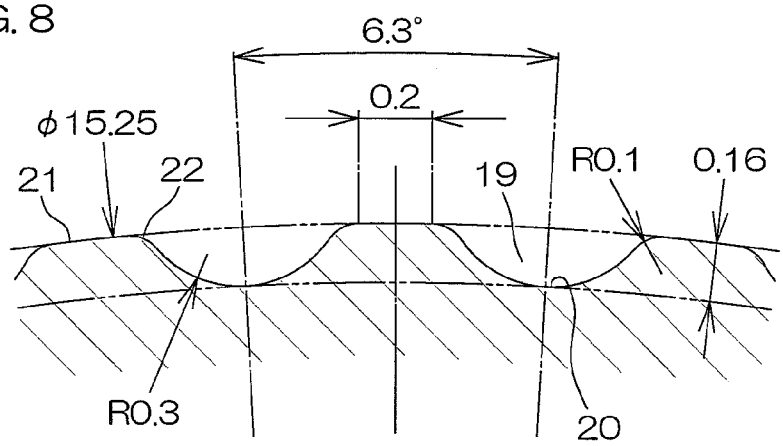
FIG. 8 is a sectional view for explaining the shape and the dimensions of grooves of a sheet conveying roller of Comparative Example 2.

An angularly knurled sheet conveying roller of the prior art was produced in substantially the same manner as in Example 1, except that a different mold was used to produce a roller body 2 including grooves 19 each having a generally U-shaped cross section. The dimensions and the number of the grooves 19 are shown in FIG. 8 and described below:

(m) An open angle θ defined between adjacent grooves 19: 6.3 degrees (n) A distance between the adjacent grooves 19: 0.71 mm (o) The depth of a groove 19: 0.16 mm (p) The radius of a bottom 20 of the groove 19: 0.3 mm (q) The width of a cylindrical surface portion 21 between the adjacent grooves 19: 0.2 mm (r) The radius of a corner 22 between the groove 19 and the cylindrical surface portion 21: 0.1 mm (s) The number of the grooves 19: 57

The roller body 2 had the same maximum diameter, the same inner diameter and the same length as in Example 1.

Comparative Example 3

Figure 9:
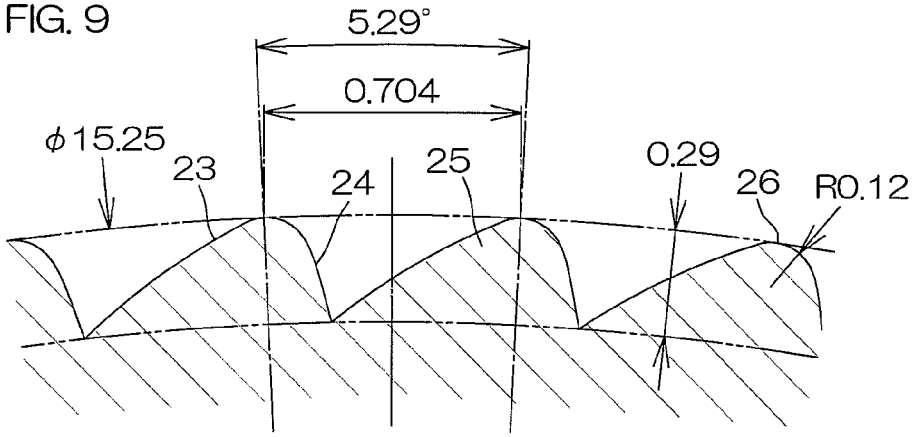
FIG. 9 is a sectional view for explaining the shape and the dimensions of projections of a sheet conveying roller of Comparative Example 3.

A serrated sheet conveying roller of the prior art was produced in substantially the same manner as in Example 1, except that a different mold was used to produce a roller body 2 including linear projections 25 each having a generally triangular cross-sectional shape having two edges 23, 24 circumferentially inclined at different inclination angles, and arranged with the inclined edges 23, 24 of adjacent linear projections directly connected to each other as seen in section. The dimensions and the number of the linear projections 25 are shown in FIG. 9 and described below:

(t) An open angle θ defined between adjacent linear projections 25: 5.29 degrees (u) A distance between the adjacent linear projections 25: 0.704 mm;

(v) The height h of the linear projection 25: 0.29 mm;

(w) The radius of a distal portion 26 of the linear projection 25: 0.12 mm The roller body 2 had the same maximum diameter, the same inner diameter and the same length as in Example 1.

Comparative Example 4

An ordinary sheet conveying roller was produced in substantially the same manner as in Example 1, except that a different mold was used to produce a roller body of a cylindrical shape having an outer peripheral surface formed with neither the linear projections nor the grooves but polished to have a surface roughness Rz of 30 μm. The roller body had the same maximum diameter, the same inner diameter and the same length as in Example 1.

<Measurement of Friction Coefficient and Sheet Conveying Test>

The sheet conveying rollers thus produced in the examples and the comparative examples were each brought into press contact with a paper sheet (Xerox Business 4200 available from Xerox Corporation and having a width of 60 mm and a length of 210 mm) placed on a TEFLON (registered trade name) plate with a vertical load of 200 gf and, in this state, a transportation force F acting on the paper sheet was measured by means of a load cell while the sheet conveying roller was rotated at 120 rpm. Then, a friction coefficient μ was determined from the following expression (4):

$$\mu = F/200 \quad (4)$$

Measurement was performed immediately after the production of each of the sheet conveying rollers (initial measurement). Then, the sheet conveying rollers were each incorporated as a sheet feed roller in a monochrome laser printer (JUSTIO (registered trade name) HL-2140 available from Brother Industries, Ltd.) and measurement was performed again after 1,000 postcards made from not less than 40% recycled paper were sequentially conveyed by the sheet feed roller until a transportation failure occurred (post-endurance measurement).

Then, the number of sequentially conveyed postcards was recorded.

The test described above was performed in a normal temperature and normal humidity environment (NN environment) at a temperature of 23° C. at a relative humidity of 55%.

<Sheet Conveying Test in Lower Temperature and Lower Humidity Environment>

Immediately after the production, the sheet conveying rollers were each incorporated as a sheet feed roller in a monochrome laser printer (JUSTIO (registered trade name) HL-2140 available from Brother Industries, Ltd.), and 50,000 higher-talc-content copy sheets (JK COPIER made in India) at the maximum were sequentially conveyed by the sheet feed roller until a transportation failure occurred. Then, the number of the sequentially conveyed copy sheets was recorded.

The results are shown in Tables 1 and 2.

TABLE 1

| | Example 1 | Example 2 | Example 3 | Example 4 | Example 5 |
|---|---|---|---|---|---|
| Roller body | | | | | |
| Sectional shape | FIG. 3 | FIG. 3 | FIG. 4 | FIG. 5 | FIG. 6 |
| Open angle θ (degrees) | 5.29 | 5.29 | 8 | 3.53 | 5.29 |
| Height h (mm) | 0.29 | 0.29 | 0.29 | 0.29 | 0.29 |
| Radius r1 (mm) | 0.12 | 0.12 | 0.12 | 0.12 | 0.14 |
| Radius r2 (mm) | 0.1 | 0.1 | 0.1 | 0.1 | 0.05 |
| Rubber component | EPDM | EPDM + IR | EPDM | EPDM | EPDM |
| Friction coefficient | | | | | |
| Initial | 1.7 | 1.8 | 1.8 | 1.8 | 1.7 |
| Post-endurance μ | 1.5 | 1.7 | 1.5 | 1.4 | 1.5 |
| Number of sequentially conveyed sheets | | | | | |
| Postcards (in NN environment) | 1,000 | 1,000 | 1,000 | 800 | 900 |
| Copy sheets (in LL environment) | 50,000 | 50,000 | 50,000 | 45,000 | 50,000 |

TABLE 2

| | Comparative Example 1 | Comparative Example 2 | Comparative Example 3 | Comparative Example 4 |
|---|---|---|---|---|
| Roller body | | | | |
| Sectional shape | FIG. 7 | FIG. 8 | FIG. 9 | No undulation |
| Rubber component | EPDM | EPDM | EPDM | EPDM |
| Friction coefficient | | | | |
| Initial | 1.8 | 1.9 | 1.7 | 2 |
| Post endurance μ | 1.2 | 1.2 | 1.3 | 1.1 |
| Number of sequentially conveyed sheets | | | | |
| Postcards (in NN environment) | 300 | 200 | 400 | 150 |
| Copy sheets (in LL environment) | 40,000 | 30,000 | 40,000 | 15,000 |

The results for Comparative Examples 1 to 4 shown in Table 2 indicate that the K-type knurled roller, the angularly knurled roller and the serrated sheet conveying roller of the prior art suppressed the reduction in friction coefficient to improve the sheet transportation failure preventing effect to some extent in the normal temperature and normal humidity environment and in the lower temperature and lower humidity environment as compared with the sheet conveying roller of Comparative Example 4 formed with neither the linear projections nor the grooves, but the effect was insufficient.

In contrast, the results for Examples 1 to 5 shown in Table 1 indicate that the sheet conveying rollers 1 each including the linear projections 6 each having a generally right-angled triangular cross sectional shape satisfying the requirements specified by the present invention significantly suppressed the reduction in friction coefficient to reliably prevent the sheet transportation failure in the normal temperature and normal humidity environment and in the lower temperature and lower humidity environment as compared with the comparative examples.

The results for Examples 1 to 5 indicate that the open angle θ defined between the adjacent linear projections 6 about the center axis is preferably not less than 2 degrees and not greater than 8 degrees, that the height h of the linear projection 6 as radially measured is preferably not less than 0.1 mm and not greater than 0.5 mm, and that the open angle θ is particularly preferably not less than 4 degrees within the aforementioned range.

The results for Examples 1 and 2 indicate that the roller body 2 is preferably unitarily formed of the crosslinking product of the rubber composition containing the EPDM as the rubber component and the peroxide as the crosslinking agent, and the rubber component particularly preferably contains the IR and the EPDM in a mass ratio (IR/EPDM) of not less than 10/90 and not greater than 50/50.

The results for Examples 1 to 4 indicate that the radius r1 of the curve 10 connecting the hypotenuse edge 7 and the adjoining edge 9 of each of the linear projections 6 as seen in section is preferably not less than 0.08 mm and not greater than 0.15 mm, particularly preferably not less than 0.1 mm and not greater than 0.13 mm.

Further, the results for Examples 1 to 3 and 5 indicate that the radius r2 of the curve 11 connecting the hypotenuse edge 7 of one of each two adjacent linear projections 6 and the adjoining edge 9 of the other linear projection 6 as seen in section is preferably not less than 0.03 mm and not greater than 0.14 mm, particularly preferably not less than 0.08 mm and not greater than 0.12 mm.

This application corresponds to Japanese Patent Application No. 2012-174777 filed in the Japan Patent Office on Aug. 7, 2012, the disclosure of which is incorporated herein by reference in its entirety.

What is claimed is:

1. A sheet conveying roller comprising:

a tubular roller body unitarily formed of an elastic material and having a plurality of linear projections circumferentially equidistantly provided on an outer peripheral surface thereof as extending axially of the roller body;

wherein the linear projections each have a generally right-angled triangular cross section taken perpendicularly to a center axis of the roller body, the generally right-angled triangular cross section including a hypotenuse edge and an adjoining edge located on a forward side and on a rearward side, respectively, with respect to a circumferential roller body rotation direction, the adjoining edge aligning with a line perpendicular to the center axis of the roller body;

wherein a corner defined between the hypotenuse edge and the adjoining edge of each of the linear projections is rounded as seen in section;

wherein a corner defined between the hypotenuse edge of one of each two adjacent linear projections and the adjoining edge of the other linear projection is rounded as seen in section.

2. The sheet conveying roller according to claim 1, wherein an open angle defined between each two adjacent linear projections about the center axis is not less than 2 degrees and not greater than 8 degrees.

3. The sheet conveying roller according to claim 2, wherein the linear projections each have a height of not less than 0.1 mm and not greater than 0.5 mm as measured radially of the roller.

4. The sheet conveying roller according to claim 3, wherein the roller body is unitarily formed of a crosslinking product of a rubber composition comprising an ethylene propylene rubber as a rubber component and a peroxide as a crosslinking agent.

5. The sheet conveying roller according to claim 4, wherein the rubber component comprises the ethylene propylene rubber and an isoprene rubber, and a mass ratio of the isoprene rubber to the ethylene propylene rubber is not less than 10/90 and not greater than 50/50.

6. An image forming apparatus comprising:

an image forming mechanism; and a sheet conveying roller which conveys a sheet to the image forming mechanism;

wherein the sheet conveying roller comprises a tubular roller body unitarily formed of an elastic material and having a plurality of linear projections circumferentially equidistantly provided on an outer peripheral surface thereof as extending axially of the roller body;

wherein the linear projections each have a generally right-angled triangular cross section taken perpendicularly to a center axis of the roller body, the generally right-angled triangular cross section including a hypotenuse edge and an adjoining edge located on a forward side and on a rearward side, respectively, with respect to a circumferential roller body rotation direction, the adjoining edge aligning with a line perpendicular to the center axis of the roller body;

wherein a corner defined between the hypotenuse edge and the adjoining edge of each of the linear projections is rounded as seen in section;

wherein a corner defined between the hypotenuse edge of one of each two adjacent linear projections and the adjoining edge of the other linear projection is rounded as seen in section.

7. The image forming apparatus according to claim 6, wherein an open angle defined between each two adjacent linear projections of the sheet conveying roller about the center axis is not less than 2 degrees and not greater than 8 degrees.

8. The image forming apparatus according to claim 7, wherein the linear projections of the sheet conveying roller each have a height of not less than 0.1 mm and not greater than 0.5 mm as measured radially of the roller.

9. The image forming apparatus according to claim 8, wherein the roller body of the sheet conveying roller is unitarily formed of a crosslinking product of a rubber composition comprising an ethylene propylene rubber as a rubber component and a peroxide as a crosslinking agent.

10. The image forming apparatus according to claim 9, wherein the rubber component of the rubber composition for the sheet conveying roller comprises the ethylene propylene rubber and an isoprene rubber, and a mass ratio of the isoprene rubber to the ethylene propylene rubber is not less than 10/90 and not greater than 50/50.

* * * * *